US011767644B2

(12) United States Patent
Burgon

(10) Patent No.: US 11,767,644 B2
(45) Date of Patent: Sep. 26, 2023

(54) MODULE FOR CONSTRUCTION OF RECREATION TRACK, ESPECIALLY BICYCLE ONE

(71) Applicant: PARKITECT s.r.o., Valasska Polanka (CZ)

(72) Inventor: Erik Burgon, Speicher (CH)

(73) Assignee: PARKITECT s.r.o., Valasska Polanka (CZ)

( * ) Notice: Subject to any disclaimer, the term of this patent is extended or adjusted under 35 U.S.C. 154(b) by 0 days.

(21) Appl. No.: 18/010,665

(22) PCT Filed: Jun. 18, 2021

(86) PCT No.: PCT/CZ2021/000032
§ 371 (c)(1),
(2) Date: Dec. 15, 2022

(87) PCT Pub. No.: WO2021/254545
PCT Pub. Date: Dec. 23, 2021

(65) Prior Publication Data

US 2023/0160150 A1 May 25, 2023

(30) Foreign Application Priority Data

Jun. 18, 2020 (PL) ..... W.129303

(51) Int. Cl.
*E01C 15/00* (2006.01)
*A63C 19/10* (2006.01)

(52) U.S. Cl.
CPC ..... *E01C 15/00* (2013.01); *A63C 19/10* (2013.01)

(58) Field of Classification Search
CPC ..... A63C 19/10
(Continued)

(56) References Cited

U.S. PATENT DOCUMENTS 830,853 A * 9/1906 Thompson ..... A63G 21/00 14/69.5
4,176,982 A * 12/1979 Boswell ..... E01C 5/18 404/34

(Continued)

FOREIGN PATENT DOCUMENTS

BE 866965 A 9/1978
EP 0378725 A1 7/1990

(Continued)

OTHER PUBLICATIONS

International Search Report issued by the European Patent Office for International Patent Application No. PCT/CZ2021/000032, dated Nov. 16, 2021.

(Continued)

*Primary Examiner* — Raymond W Addie
(74) *Attorney, Agent, or Firm* — MYERS WOLIN, LLC

(57) ABSTRACT

A module for construction of recreation track, especially bicycle one, having a framework on which the modules are being arranged, whereas the module has upper part intended for riding on it, constituting non-ruled surface, and in the top view it has tetragon shape with one rounded side, the first side wall and the second side wall, whereas the first side wall and the second side wall create base of the module, and the left front wall and opposite to it right front wall, located between the first side wall and the second side wall, characteristic in that, the left front wall and the right front wall form in the top view an acute angle (α), and the first side wall and the second side wall form obtuse angles with the upper part.

7 Claims, 4 Drawing Sheets

(58) Field of Classification Search
USPC ..... 404/17, 34–46
See application file for complete search history.

(56) References Cited

U.S. PATENT DOCUMENTS

| | | | | | |
|---|---|---|---|---|---|
| 5,152,632 | A * | 10/1992 | Hawkes | ..... | E01C 15/00 404/20 |
| 5,457,837 | A * | 10/1995 | Zuckerbrod | ..... | E01B 5/04 238/10 R |
| D500,829 | S | 1/2005 | Hadley | | |
| 2004/0197147 | A1* | 10/2004 | Kennedy | ..... | E02D 17/10 404/35 |

FOREIGN PATENT DOCUMENTS

| | | | |
|---|---|---|---|
| EP | 0796641 | A1 | 9/1997 |
| EP | 0870523 | | 10/1998 |
| FR | 2757075 | A1 | 6/1998 |

OTHER PUBLICATIONS

Anonymous, "pumptrack eu catalog 2019", Jan. 1, 2019, pp. 1-23, Retrieved from the Internet: URL: https://www.pumptrack.eu/i/cms/pumptrack_catalog_2019_en_pdf on Sep. 17, 2021.

Parkitect: "Parkitect AG Reutenenstrasse 22 9042 Speicher Switzerland Montage Anleitung", Feb. 26, 2018, Retrieved from the Internet: URL: https//sh.ch/CMS/get/file/9f5c5c9e-2332-4c90-af98-cffcef633bba on Oct. 4, 2021, with English Abstract.

* cited by examiner

MODULE FOR CONSTRUCTION OF RECREATION TRACK, ESPECIALLY BICYCLE ONE

CROSS REFERENCE TO RELATED APPLICATIONS

The present application is a U.S. National Phase under 35 U.S.C. 371 of International Patent Application Serial No. PCT/CZ2021/000032, filed on Jun. 18, 2021, which claims priority to Polish Application W. 129303, filed on Jun. 18, 2020, the contents of each of which are incorporated by reference in their entirety for all purposes.

FIELD OF THE INVENTION

The subject of the utility model is a module for construction of recreation track, especially bicycle one.

BACKROUND

Recreation tracks, intended particularly for riding a bicycle, but also inline skates, are known under pumptrack name and constitute specially prepared, small track, enabling riding a one-track vehicle (usually bicycle) and provide for comprehensive training. It is constructed from quick turns and moguls. It develops reflex, balance sense and condition of its users.

The modular track for riding inline skates is known from the French application document FR2757075. The track is made of horizontal surface, connected with modular, curved sections. The upper part of ending section is covered with a bumper having cylindrical shape. The slope is connected with platform by means of safety barrier. The curved surfaces are supported by frame, created of vertical, horizontal and oblique rods. They are stiffened with triangular rods and connected with each other by means of assembly plates. The horizontal surface is supported by the rods placed underneath, and inclination can be changed by means of variable height feet.

Solution of track, especially intended for skateboard and made of individual modules, is known from the European application document EP0378725A1. In order to arrange a track for skateboarding, which can be constructed in open air and which is long-life, while simultaneously has perfect rolling properties, it is proposed to construct the skateboard track from individual modules, which comprise of precast concrete units, so that feature perfect rolling properties on their running side, while simultaneously produce lower noise level than the tracks known to date.

The solution of inline skates track, made of individual elements, is known from the European application EP0870523A1. The structure of the track is composed of multiple sections, which create hollow track with flat bottom and a number of ending sections, with which the structure obtains closed, semi-circular end. The hollow track is composed of concave sections, which have flat, horizontal platforms along elevation. The platforms serve starting or landing. Users may also move along the structure and along its semi-circular end. The concave sections are supported by struts. The structure can be supplemented with canopy.

The solution of inline skates track, made of individual elements, is known from the European application EP0796641A1. The inline skates track, containing at least one part with bent surface, whereas this part is composed of bent surface, which is supported mainly by curved strips, extending mainly in curvature direction of the bent plate.

The known tracks can be made of wood, concrete or also plastic, whereas, for example concrete can by poured out on-site of the track construction, or can be also made in form of modular components, produced outside the site and adequately selected, as required, which depends on terrain configuration or necessity of ensuring adequate construction of the track.

The recreation tracks known in the art, particularly the tracks made of concrete components, are distinguished with large weight, which entails high difficulties during their construction and also influences their cost. It is also important, that considering their geometry, known tracks do not provide optimum safety level for users.

SUMMARY

The utility model aims at providing modular components for construction of recreation track, especially the bicycle one, which besides low costs of the track construction shall provide optimum trajectory of user run, which contributes to ergonomics and safety of the run and also provides possibility of constructing tracks featuring various shapes.

The module for construction of recreation track, especially bicycle one, applies to construction of track having a framework, on which the modules are being arranged. The module has upper part intended for riding on it, constituting non-ruled surface. In the top view the module has tetragonal shape with one rounded side, it has the first side wall and the second side wall. The first side wall and the second side wall create base of the module. The module has left front wall and opposite to it right front wall, located between the first side wall and the second side wall. The module according to utility model is characteristic in that, the front left wall and front right wall form acute angle in the top view, and the first side wall and the second side wall form obtuse angle with the upper part.

Preferably, the upper part intended for riding on it, constitutes non-ruled surface, which in the view from the left side wall is concave towards base, formed by the first side wall and the second side wall.

Furthermore preferably, the first side wall and the second side wall have in side-view, shape of figure having three straight sides and one side constituting and arch, bent oppositely to base, upper point of which is located between the left front wall and opposite to it right front wall.

Also preferably the acute angle, formed by the left front and right front walls, falls within 10° to 20° range.

Also preferably the first side wall is higher than the second side wall.

Furthermore preferably the edges of upper part, adjoining the first side wall and the second side wall are rounded with radius from 50 mm up to 100 mm.

Also preferably the upper part of the module, intended for riding on it, has rough surface.

BRIEF DESCRIPTION OF THE DRAWINGS

The utility model was presented in attached drawing, in which.

DETAILED DESCRIPTION OF THE PREFERRED EMBODIMENTS

Figure 1:
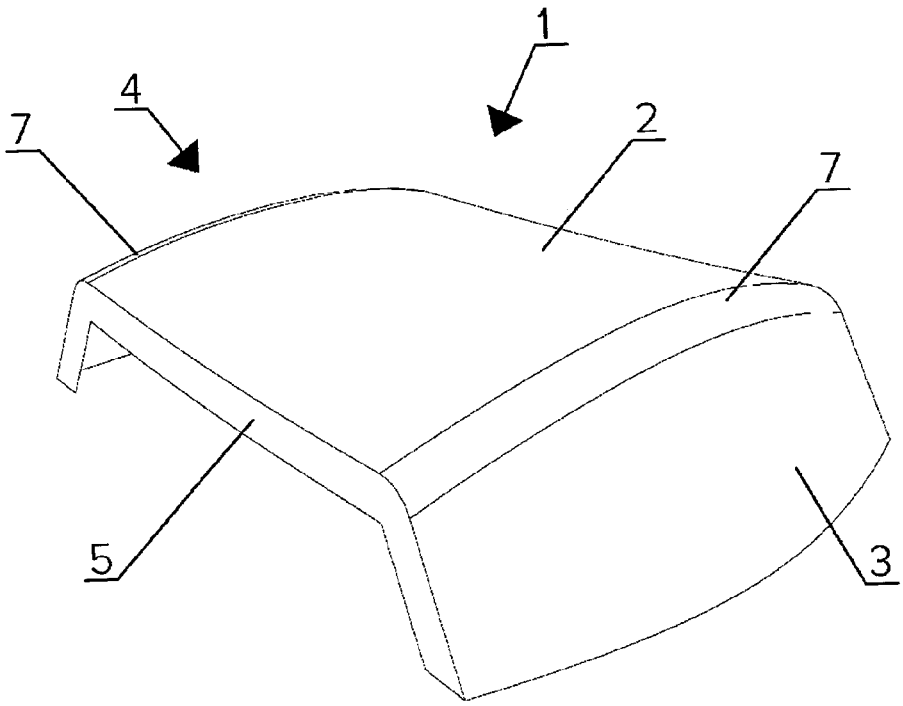
FIG. 1 illustrates the module for construction of recreation track, especially bicycle one, in perspective view from corner of the front left wall and the first side wall.
Figure 2:
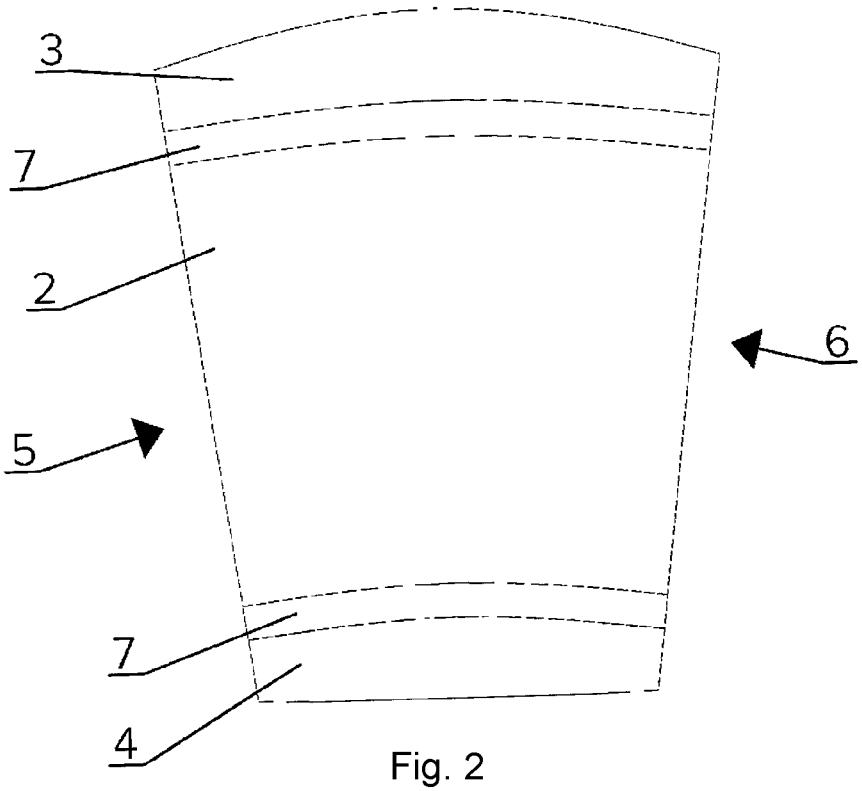
FIG. 2 illustrates the module for construction of recreation track, especially bicycle one, in the top view.
Figure 3:
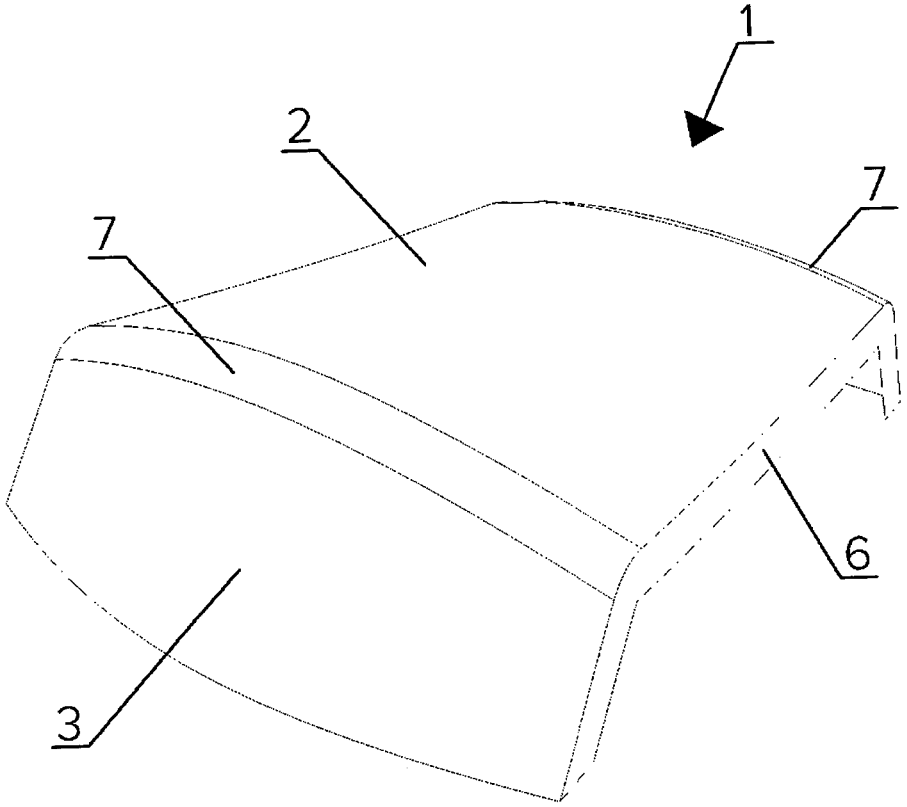
FIG. 3 illustrates the module for construction of recreation track, especially bicycle one, in perspective view from corner of the front right wall and the first side wall.

Module 1 serves construction of recreation track, especially the bicycle one, which has a framework on which the modules are being arranged.

As shown in FIG. 1, FIG. 2, FIG. 3 and FIG. 4, module 1 has upper part 2 intended for riding on it, constituting non-ruled surface and in the top view has tetragonal shape with one rounded side. Module 1 has the first side wall 3 and the second side wall 4 and left front wall 5 and opposite to it right front wall 6, located between the first side wall 3 and the second side wall 4. The terms "right" and "left" have conventional meaning, because module 1 is symmetrical to its transverse axis.

The first side wall 3 and the second side wall 4 create base of module 1. The first side wall 3 and the second side wall 4 form with upper part 2 an obtuse angles, therefore stability of module on the ground, on which it is to be seated, is increased. Whereas the left front wall 5 and the right front wall 6 form an acute angle a in the top view.

Figure 5:
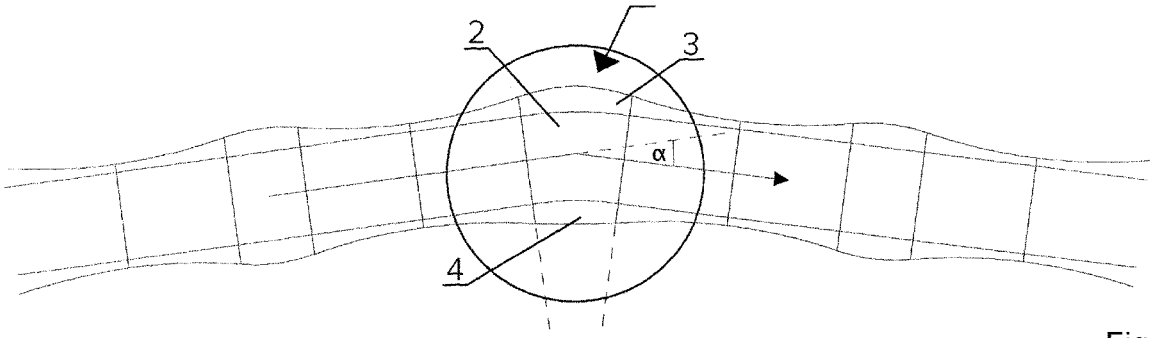
FIG. 5 illustrates fragment of example track with use of module for construction of recreation track, especially bicycle one.
Figure 6:
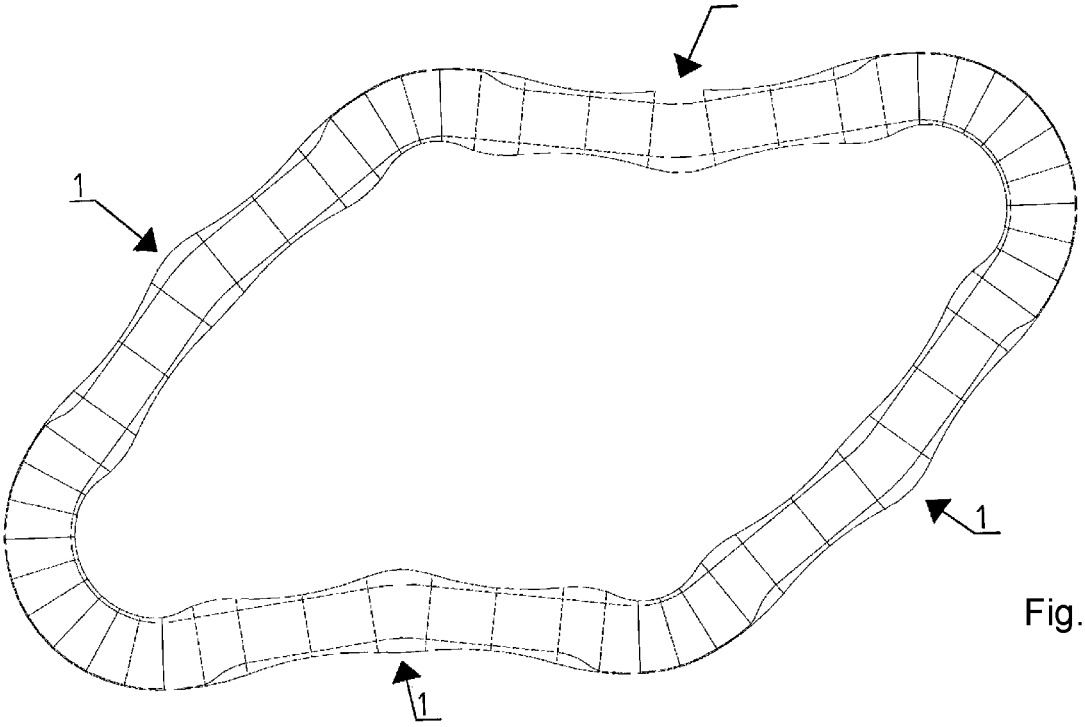
FIG. 6 illustrates location of module for construction of recreation track, especially bicycle one in example recreation track.

The left front wall 5 and the right front wall 6 serve joining the module 1 with other modules during construction of recreation track. The location of the module 1 shown in FIG. 5 and FIG. 6 within example recreation track results in changing riding direction on the track by an angle, which is equal to angle a, formed between the left front wall 5 and the right front wall 6, which is shown in FIG. 5. The acute angle a, formed by the left front wall 5 and the right front wall 6 in the module shown in FIG. 5 equals to 15°, but the acute angle in other embodiments of the track may adopt value from the 10°-20° range.

Figure 4:
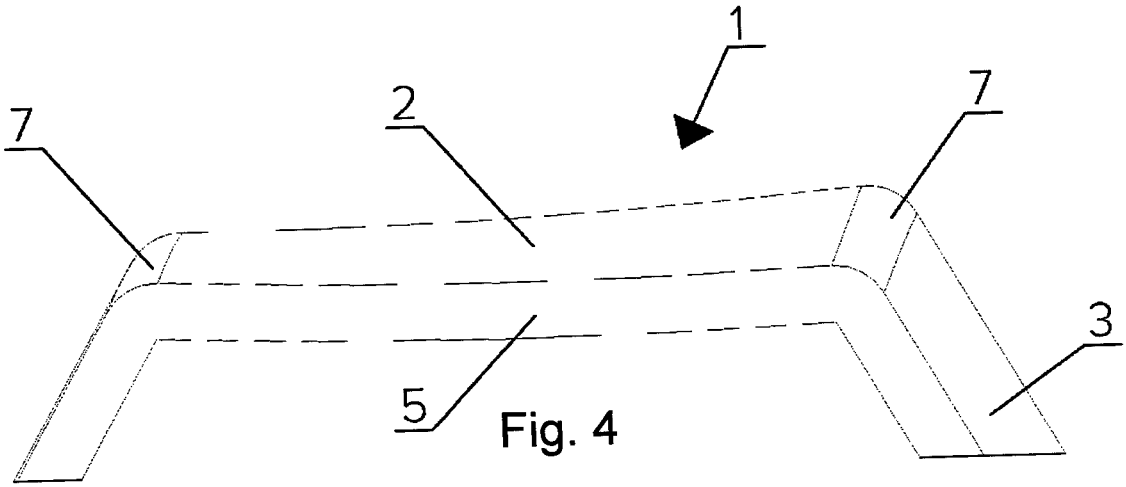
FIG. 4 illustrates the module for construction of recreation track, especially bicycle one, in straight view from the front left wall.

The upper part 2 of module 1, intended for riding on it, constitutes non-ruled surface, which in the view from the left side wall 5 is concave towards base, formed by the first side wall 3 and the second side wall 4, as shown in FIG. 4. This influences safety of a person using the track in such manner, that it reduces possibility of falling out of the track, because the concavity of upper part 2 and its inclination in transverse plane both to the first side wall 3 and the second side wall 4 results somehow in "pulling off" the person riding on the track towards the centre axis of module 1 driving direction.

The first side wall 3 and the second side wall 4 have in side-view, shape of figure having three straight sides and one side constituting an arch, bent oppositely to base, upper point of which is located between the left front wall 5 and opposite to it right front wall 6.

As shown in FIG. 4, the first side wall 3 is higher than the second side wall 4.

The edges of upper part 2, adjoining the first side wall 3 and the second side wall 4, feature rounding 7. which is shown in FIG. 1, FIG. 2, FIG. 3 and FIG. 4. The radius of rounding 7 ranges from 50 mm up to 100 mm, The upper part 2 of module 1. intended for riding on it. has rough surface. which increases running safety, and the roughness is obtained by painting the module 1 with paint, laying a layer of quartz silica over it prior to the paint is dried out, removing excess silica after the paint is dried out and laying subsequent layer of the paint.

The module 1 for construction of recreation track, especially the bicycle one, is made of glass fibre reinforced plastic.

The invention claimed is:

1. A module for construction of recreation track having a framework on which the modules are being arranged, whereas the module has upper part intended for riding on it, constituting non-ruled surface, and in the top view it has tetragon shape with one rounded side, the first side wall and the second side wall, whereas the first side wall and the second side wall create base of the module, and the left front wall and opposite to it right front wall, located between the first side wall and the second side wall, wherein the left front wall (5) and the right front wall (6) form in the top view an acute angle ($\alpha$), and the first side wall (3) and the second side wall (4) form obtuse angles with the upper part (2).

2. The module according to claim 1, wherein the upper part (2) intended for riding on, constitutes non-ruled surface, which in the view from the left side wall (5) is concave towards base, formed by the first side wall (3) and the second side wall (4).

3. The module according to claim 1, wherein the first side wall (3) and the second side wall (4) in side-view, have shape of figure having three straight sides and one side constituting and arch, bent oppositely to base, upper point of which is located between the left front wall (5) and opposite to it right front wall (6).

4. The module according to claim 1, wherein the acute angle (a), formed by the left front wall (5) and right front wall (6), falls within 10° to 20° range.

5. The module according to claim 1, wherein the first side wall (3) is higher than the second side wall (4).

6. The module according to claim 1, wherein the edges of upper part (2), adjoining the first side wall (3) and the second side wall (4) have rounding (7) with radius ranging from 50 mm up to 100 mm.

7. The module according to claim 1, wherein the upper part (2) of module (1), intended for riding on it, has rough surface.

* * * * *